1/28/86 OR 4,566,862

United States Patent [19]

Halavais

[11] Patent Number: 4,566,862

[45] Date of Patent: Jan. 28, 1986

[54] FLUID APPARATUS AND METHODS, AS FOR INFLATING INFLATABLE STRUCTURES

[75] Inventor: Richard A. Halavais, Pompton Lakes, N.J.

[73] Assignee: General Pneumatics Corporation, Orange, N.J.

[21] Appl. No.: 632,267

[22] Filed: Jul. 19, 1984

Related U.S. Application Data

[63] Continuation of Ser. No. 351,587, Feb. 23, 1982, abandoned.

[51] Int. Cl.[4] ..... F04F 5/48

[52] U.S. Cl. ..... 417/189; 417/174; 417/191; 441/41

[58] Field of Search ..... 417/187-189, 417/190, 191, 196, 198, 174, 151, 178; 441/40, 41; 137/895

[56] References Cited

U.S. PATENT DOCUMENTS

| | | | |
|---|---|---|---|
| Re. 27,860 | 1/1974 | Day | 417/184 |
| 434,997 | 8/1890 | Schutte | 417/189 |
| 1,614,574 | 1/1927 | Schmidt | 417/54 |
| 2,595,218 | 5/1952 | Allen | 137/21 |
| 2,772,829 | 12/1956 | Crawford et al. | 230/95 |
| 2,866,593 | 12/1958 | Bowman et al. | 230/95 |
| 2,975,958 | 3/1961 | Kane | 230/95 |
| 3,042,290 | 7/1962 | Fraebel | 230/95 |
| 3,056,540 | 10/1962 | Marsh et al. | 230/95 |
| 3,150,388 | 9/1964 | Oliphant | 441/41 |
| 3,158,314 | 11/1964 | Young et al. | 230/95 |
| 3,204,862 | 9/1965 | Hadeler | 230/95 |
| 3,241,316 | 3/1966 | Endres | 60/39.5 |
| 3,338,266 | 8/1967 | Zilka et al. | 137/604 |
| 3,441,045 | 4/1969 | Malone | 137/114 |
| 3,448,691 | 6/1969 | Frazier | 103/271 |
| 3,456,871 | 7/1969 | Gosling | 230/111 |
| 3,460,746 | 8/1969 | Green et al. | 230/104 |
| 3,460,747 | 8/1969 | Green et al. | 230/104 |
| 3,468,472 | 9/1969 | Hahn | 230/95 |
| 3,591,314 | 7/1971 | Day | 417/179 |
| 3,598,504 | 8/1971 | Siravo | 417/184 |
| 3,606,586 | 9/1971 | Piet et al. | 417/177 |
| 3,640,645 | 2/1972 | Forsythe | 417/174 |
| 3,684,404 | 8/1972 | Galbraith | 417/184 |
| 3,771,913 | 11/1973 | MacPherson et al. | 417/179 |
| 3,791,764 | 2/1974 | Summer | 417/185 |
| 3,868,125 | 2/1975 | Fisher et al. | 280/150 |

OTHER PUBLICATIONS

*The Condensed Chemical Dictionary*, Reinhold Publishing Corporation, 1950, p. 19.

*Primary Examiner*—Edward K. Look
*Attorney, Agent, or Firm*—Shapiro and Shapiro

[57] ABSTRACT

In a system for inflating airslides and the like, the pressure of the primary gas supplied to an ejector is controlled so as to maintain a constant mass flow rate into the airslide over its inflation cycle. A controller for controlling the primary gas pressure may be integrated into the ejector. A novel ejector employs flow shaping of an expanding primary gas stream within a draft tube to create a flow potential that produces entrainment of a secondary fluid. The draft tube may comprise telescoping sections to provide an ejector having a compact structure but which is capable of affording a substantial mixing length for the primary gas and secondary fluid when operated. The draft tube may be biased into engagement with flapper valves that close the secondary fluid openings in the ejector to afford positive closure of the openings. An argon and carbon dioxide primary gas mixture enables entrainment of a given quantity of secondary fluid within a smaller quantity of primary gas.

8 Claims, 10 Drawing Figures

180
184
186
188
182
190
196
200
192
198
194
202
78
108
142
80
204
72
206
124
76
90
91
208
122
120
304
82
8
310
268
216
146
276
270
274
214
312
128
126
86'
114
294
218
210

210
242
250
240
216
276
262
266
252
258
268
264
254
270
260
274
256
280
284
282
214
286
224
272
288
290
226
292
222
234
246
244
248
230
232
218
220

FLUID APPARATUS AND METHODS, AS FOR INFLATING INFLATABLE STRUCTURES

BACKGROUND OF THE INVENTION

This is a continuation of co-pending application Ser. No. 351,587 filed on Feb. 23, 1982, now abandoned.

The present invention relates generally to fluid apparatus and methods and more particularly to improvements in pneumatic apparatus, components, systems and methods especially adapted for inflating inflatable structures such as aircraft emergency evacuation slides, life rafts, crash bags, and the like.

The prior art is replete with various apparatus and systems employing devices such as ejectors, aspirators, jet pumps, etc., that may be referred to generically as "mass flow augmentation devices", which utilize a high pressure, high velocity primary fluid flow through a containment structure, for example a venturi, to induce and control a secondary fluid flow through the containment structure. An important application of pneumatic apparatus and systems employing mass flow augmentation devices is the inflation of inflatable structures such as aircraft emergency evacuation slides (hereinafter referred to as "airslides"), life rafts, crash bags, and the like.

Pneumatic apparatus and systems for inflating such inflatable structures typically comprise a quantity of stored primary gas (a mixture of nitrogen and carbon dioxide, for example) and a mass flow augmentation device such as an ejector (normally referred to as an "aspirator" in the airslide art) responsive to the flow of the primary gas therethrough for entraining secondary gas, e.g., outside air, to produce a combined gas flow into the inflatable structure. Ejectors enable rather large quantities of secondary gas to be entrained with small quantities of primary gas to produce a large combined mass flow into the inflatable structure. The quantity of primary gas required to entrain a given quantity of secondary gas so as to produce a total mass flow sufficient to inflate the inflatable structure is primarily a function of the efficiency of the ejector and, of course, the volume of the inflatable structure. The efficiency of the ejector also affects the inflation time. Lower efficiencies necessitate greater quantities of stored primary gas and cause longer inflation times.

Since inflatable structures such as airslides are generally deployed only in emergency situations, rapid inflation times are desirable. Furthermore, since weight is often important, particularly in aircraft, it is desirable to minimize the weight (and also the size) of the bottles used for storing the primary gas. Accordingly, high efficiencies are desirable. Unfortunately, many known airslide inflation apparatus and systems suffer from low efficiency. Low efficiency is also characteristic of many other fluid apparatus and systems that employ mass flow augmentation devices.

It is desirable to provide new and improved fluid apparatus, systems, components and methods, particularly for inflating inflatable structures, which avoid these and other disadvantages of known apparatus, systems, components and methods, and it is to this end that the present invention is directed.

SUMMARY OF THE INVENTION

The invention provides new and improved fluid apparatus, components, systems, and methods particularly, although not exclusively, adapted for inflating inflatable structures and which provide significant advantages over prior art apparatus, components, systems, and methods. For example, the invention provides higher efficiency and better mass flow characteristics than does the prior art, thereby enabling an inflatable structure to be inflated more rapidly and with a smaller quantity of primary gas.

In accordance with one aspect, the pressure of a primary gas supplied to a mass flow augmentation means that employs the primary gas for entraining a secondary gas to produce a combined fluid flow into an inflatable object is controlled in response to the static pressure in the inflatable object.

The invention also provides a novel controller adapted to be integrated with a mass flow augmentation device as an integral part thereof and having means for controlling the pressure of a primary gas supplied to the mass flow augmentation device in response to the static pressure against which the device operates. In a preferred form, the primary pressure is controlled in accordance with the difference between the static pressure and the dynamic flow pressure.

In another aspect, the invention provides mass flow augmentation apparatus in which a primary gas is caused to expand within a containment structure in such a manner so as to create a flow potential that causes entrainment of secondary fluid to provide a combined fluid flow through the containment structure. The apparatus of the invention operates in a substantially different manner from known forms of mass flow augmentation apparatus and achieves significantly higher efficiencies. In addition, for applications requiring varying flow rates, the apparatus of the invention is more easily controlled than known devices.

The invention further provides mass flow augmentation apparatus in which a draft tube, movable in response to the introduction of primary gas into the apparatus, is employed for engaging closure means which closes an opening in the apparatus for admitting secondary fluid, thereby providing positive closure of the closure means.

The invention further provides mass flow augmentation apparatus that comprises a draft tube formed of telescoping draft tube sections which are normally biased together in a non-extended position to provide a very compact apparatus, but which are extendable upon the introduction of primary gas into the apparatus to form a draft tube having a length that optimizes the energy transfer between a primary gas and an entrained secondary fluid.

In accordance with yet a further aspect, the invention provides a gas mixture comprising argon and carbon dioxide that significantly reduces the quantity of primary gas required to entrain a given amount of secondary gas in mass flow augmentation apparatus.

DESCRIPTION OF THE PREFERRED EMBODIMENTS

The invention involves several distinct although related aspects which may be employed individually or in combination in fluid apparatus, systems, and methods. Although the various aspects of the invention will be described in connection with pneumatic apparatus, systems, components and methods for the inflation of inflatable structures, specifically airslides, this is illustrative of only one utility of the invention, and it will become apparent that the principles of the invention have wider applicability.

Figure 1:
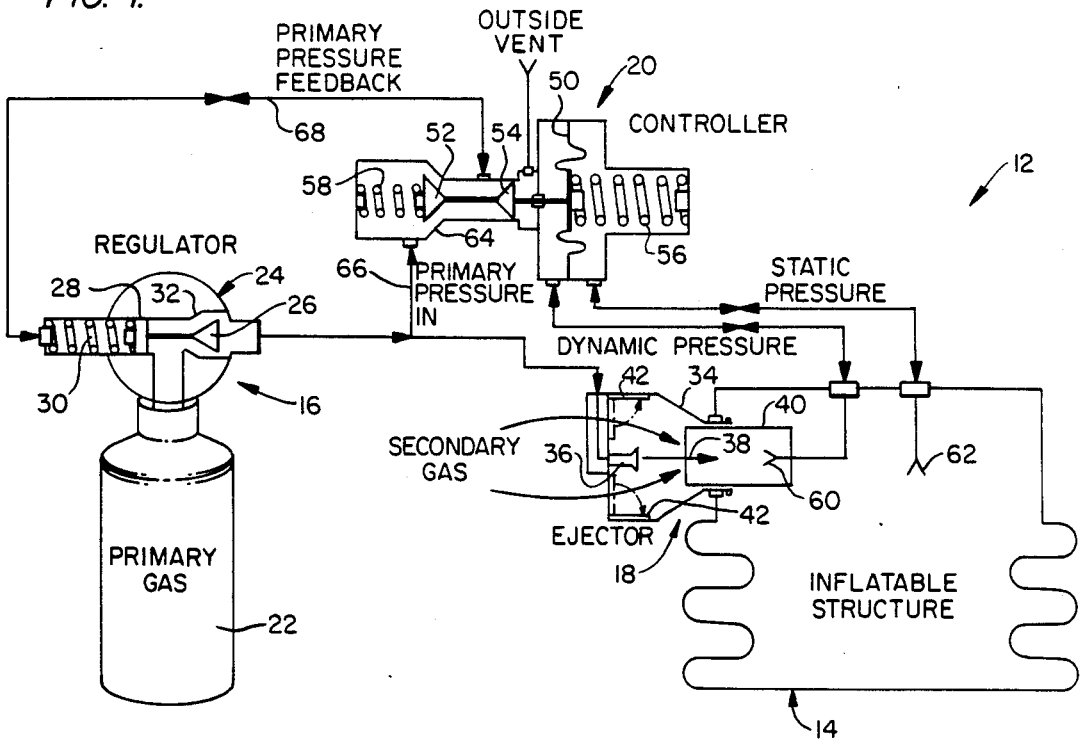
FIG. 1 is a schematic diagram illustrating a fluid system in accordance with one aspect of the invention.

FIG. 1 illustrates schematically a fluid, more particularly a pneumatic, system 12 in accordance with one aspect of the invention for inflating an inflatable structure 14, which may be an airslide, for example. As shown, system 12 may generally comprise a source 16 of pressurized primary gas, a mass flow augmentation device, e.g., an ejector, 18, and a controller 20, connected together in a feedback system arrangement as illustrated and as will be described in detail hereinafter. Source 16 of primary gas may include a bottle or tank 22 of compressed primary gas, such as a mixture of nitrogen and carbon dioxide, for example, and a regulator 24 which controls the pressure of the primary gas supplied from the bottle. The regulator may comprise a poppet valve 26 connected to a movable piston 28 that is normally biased by a spring 30 to a predetermined open position. Until the system is activated, the regulator is in a closed position at which valve 26 is held seated against a valve seat 32, as by a pin (not illustrated), for example, and spring 30 is compressed somewhat by piston 28. When the pin is removed to activate the system, spring 30 moves piston 28 to its predetermined open position, thereby unseating valve 26 so that primary gas may flow to the ejector.

Ejector 18 may comprise a housing 34 having a primary nozzle 36 for supplying a stream 38 of high pressure, high velocity primary gas through a draft tube 40 into the airslide 14. The primary gas stream flowing through the draft tube causes entrainment of secondary gas, e.g., ambient air, which enters the housing through openings therein (as illustrated by the arrows in FIG. 1), to produce a combined gas flow into the airslide. Once the airslide has been inflated, flapper-type valves 42 may be employed for closing the secondary gas openings in the housing to prevent deflation. Ejector 18 is preferably constructed in accordance with the principles of the invention hereinafter described in detail. However, ejector 18 may also be a known type of aspirator such as is commonly employed in conventional inflation systems, and the system of FIG. 1 will provide improved results over such conventional systems.

As shown schematically in FIG. 1, controller 20 may comprise a flexible, pressure-sensitive diaphragm 50 connected to a pair of movable poppet-type valves 52 and 54. Bias springs 56 and 58 engaging the diaphragm and poppet valve 52, respectively, as shown, may be employed for establishing the initial positions of the diaphragm and the poppet valves. A dynamic pressure sensor 60, such as a pitot tube positioned within draft tube 40 of ejector 18, monitors the dynamic pressure of the combined gas mixture flowing through the draft tube and supplies this dynamic pressure to one side of diaphragm 50. A static pressure sensor 62, which may also be a pitot tube, monitors the static or back pressure in the airslide and supplies the static pressure to the other side of diaphragm 50. As will be described shortly, the diaphragm moves in response to the pressure differential between the static and the dynamic pressures and controls the positions of poppet valves 52 and 54. The pressure of the primary gas supplied by regulator 24 to ejector 18 is also supplied to the controller via a line 66, as by tapping the primary gas line to the ejector, and a primary pressure feedback path 68 is provided from the controller to regulator 24, as shown.

As noted earlier, the system of FIG. 1 is a feedback control system. It operates (in a manner to be described shortly) to dynamically control the pressure of the primary gas supplied to ejector 18 as a function of the dynamic pressure of the combined gas flow in the ejector and the static pressure of the airslide. This enables a constant mass flow rate to be maintained and the efficiency of the system to be maximized, which, in turn, minimizes the inflation time and the amount of primary gas necessary to inflate the airslide. Prior to describing the operation of the system of FIG. 1, it will be helpful to an understanding of the invention to consider various factors that influence the performance of an airslide inflation system.

Figure 2:
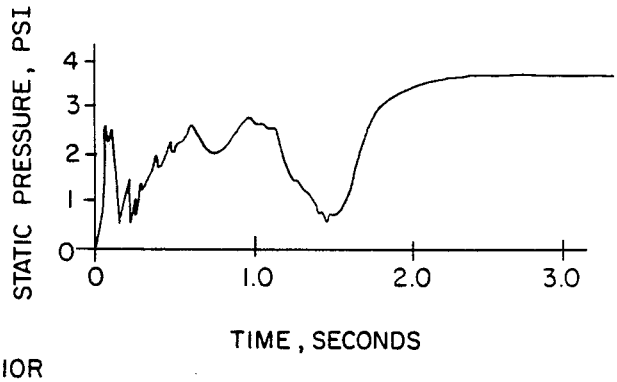
FIG. 2 is a curve illustrating a typical variation in airslide back pressure as a function of time over an inflation cycle.

FIG. 2 illustrates a typical inflation cycle of an airslide. (The inflation time in seconds illustrated in FIG. 2 is the inflation time using the invention. Using conventional inflation apparatus and systems, the inflation time will be significantly longer, as explained hereinafter. However, the pressure variation is similar to that shown.) The airslide inflation cycle is characterized by rapid changes in back pressure (static pressure) as the airslide unpacks and various deployment restraints sequentially release. Initially, there is a very rapid increase in back pressure presented to the ejector as the airslide begins to unpack, followed shortly thereafter by a rapid decrease in back pressure as the airslide free volume opens up to the in-rushing gases from the ejector. Similar increasing/decreasing pressure variations are presented to the ejector throughout the inflation cycle as the airslide unpacks and the various deployment restraints release. The highly erratic back pressure characteristic associated with a typical airslide inflation cycle greatly complicates the problem of designing an efficient inflation system. Known mass flow augmentation devices are highly sensitive to back pressure variations and their performance, i.e., efficiency, rapidly decreases with changes in back pressure.

Figure 3:
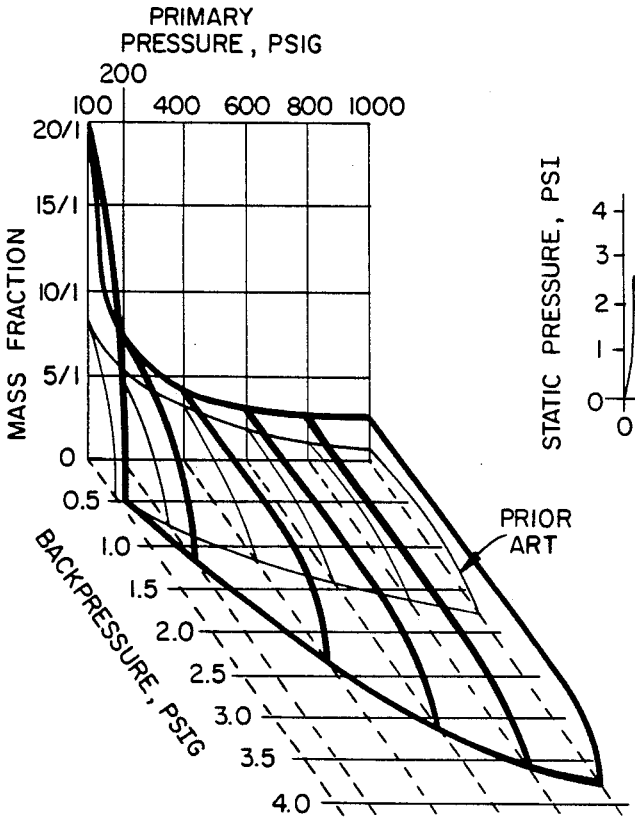
FIG. 3 is a diagram illustrating the variation in mass fraction (efficiency) of a mass flow augmentation device in accordance with the invention as a function of back pressure and primary pressure, and comparing the invention with the accepted standard of the prior art.

The efficiency of a mass flow augmentation device is measured by its mass fraction, which is defined as the ratio of induced fluid to inducing fluid at various values of back pressure working against the device. FIG. 3, which illustrates (in bold lines) the performance profile of an ejector in accordance with the invention (which will be described hereinafter) and compares this performance with the accepted performance of typical prior art ejectors (in thin lines), shows that for any given back pressure there is an optimum primary pressure where the highest efficiency is obtained. Generally, the highest efficiency, i.e., mass fraction, is obtained with the lowest value of primary pressure necessary to overcome the back pressure. Known airslide inflation systems attempt to optimize efficiency by selecting an average optimum primary pressure which is held constant over the inflation cycle, or by employing a regulator which has a progressive primary pressure characteristic so that the primary pressure is varied to approximate a moving average optimum primary pressure over the inflation cycle. However, because of the large variations in back pressure presented by an airslide over its inflation cycle, as shown in FIG. 2, it can be appreciated that such prior art systems are incapable of operating very efficiently.

In contrast, a system in accordance with the invention (such as illustrated in FIG. 1) may monitor both the static airslide back pressure and the dynamic pressure of the combined gas flow through the ejector and dynamically control the primary pressure over the entire inflation cycle to maintain it at an optimum value. Maintaining the primary pressure at its optimum value produces a constant total mass flow rate into the airslide over its inflation cycle. As a result, higher efficiency is obtained, as shown in FIG. 3, enabling the airslide to be inflated more rapidly and with a smaller quantity of primary gas than is required by prior art systems.

The system of FIG. 1 operates as follows. When an inflation cycle is initiated, as by removing a pin or other restraining means that holds valve 26 of regulator 24 seated against its valve seat, spring 30 moves piston 28 and valve 26 a predetermined amount to the right in the figure. This opens the valve and allows primary gas to flow from bottle 22 to ejector 18. The pressure of the primary gas supplied to the ejector is determined by the position of valve 26 with respect to its seat, i.e., the amount that the valve is opened, and the initial movement of piston 28 and valve 26 is selected to establish a desired initial primary pressure. (It should be noted that FIG. 1 is a schematic diagram and that the relative position of valve 26 with respect to its seat, and the positions of valves 52 and 54 of the controller with respect to their seats, have been exaggerated for clarity). As the primary gas and entrained secondary gas (outside air) flow through ejector 18 into airslide 14, the airslide static pressure begins to increase rapidly (as shown in FIG. 2), resulting in an increase in back pressure on the ejector. The increased back pressure causes the flow velocity through the ejector, and thus the dynamic pressure, to be reduced. The decrease in dynamic pressure and the increase in static pressure, as sensed by pitot tubes 60 and 62, respectively, produce a pressure differential across diaphragm 50 of the controller. When the static pressure (and the bias force of spring 56) exceeds the dynamic pressure (and the bias force of spring 58), the diaphragm flexes to the left in the figure, causing valves 52 and 54 to move to the left. This unseats valve 52 from its valve seat 64 as shown (exaggerated for clarity as previously mentioned) allowing a portion of the primary pressure supplied to the controller via line 66 to be fed back to regulator 24 via line 68. The primary pressure feedback to the regulator is applied to the back side of piston 28, as shown, where it adds to the bias force of spring 30 to increase the regulator pressure setting to a new value of primary pressure sufficiently high to overcome the airslide static pressure acting against the ejector. Conversely, when the dynamic pressure (and the bias force of spring 58) exceeds the static pressure of the airslide (and the bias force of spring 56), the diaphragm flexes to the right in the figure, causing valve 52 to reseat. This blocks the path within the controller between the primary pressure inlet line 66 and the primary pressure feedback line 68 to the regulator. At the same time, valve 54 moves to the right and unseats, allowing the primary pressure feedback to the regulator to be vented to an outside vent. This reduces the pressure applied to the back side of piston 28 of the regulator, allowing valve 26 to close somewhat, which reduces the pressure of the primary gas supplied to the ejector until an equilibrium condition is reached.

Throughout the airslide inflation cycle, the system of FIG. 1 tracks the actual back pressure of the airslide and the dynamic pressure of the combined gas flow in the ejector, and outputs a feedback signal to the regulator that is proportional to the difference between these two pressures to dynamically adjust the primary pressure to its optimum value, as shown in FIG. 3, and to maintain constant mass flow rate. This optimizes the efficiency of the inflation system, and enables the airslide to be inflated much more rapidly and with a smaller quantity of primary gas than is possible with conventional inflation systems. Moreover, the system of FIG. 1 readily compensates for differences in the inflation characteristics of individual airslides, as well as differences caused by factors such as temperature, altitude, etc., since the controller is responsive to the actual operating conditions of the ejector and the airslide.

As will be appreciated from the foregoing, variations in the system of FIG. 1 are possible. For example, the system may be designed as a feed-forward system, wherein the controller would anticipate the static pressure state of the inflatable structure and preset the pressure control signal to the regulator prior to the inflatable structure actually reaching the anticipated state. Moreover, the system could be designed as a feedforward/feedback system, wherein the controller would again anticipate the required pressure control signal but would also moderate the pressure control signal with information related to the actual state of the inflatable strcture. In addition, the system of FIG. 1 may be simplified by eliminating the dynamic pressure reference (and pitot tube 60) and by designing the controller such that it responds only to the static pressure of the inflatable structure. Such a system would be particularly useful for inflating structures such as life rafts, for example, which do not exhibit such large or rapid back pressure variations as do airslides.

As noted earlier, conventional mass flow augmentation devices, such as aspirators, may be employed in the system of FIG. 1, and the system will significantly improve their performance. However, to obtain the maximum benefits from the system, it is preferred that mass flow augmentation devices constructed in accordance with the principles hereinafter described be employed.

Figure 4:
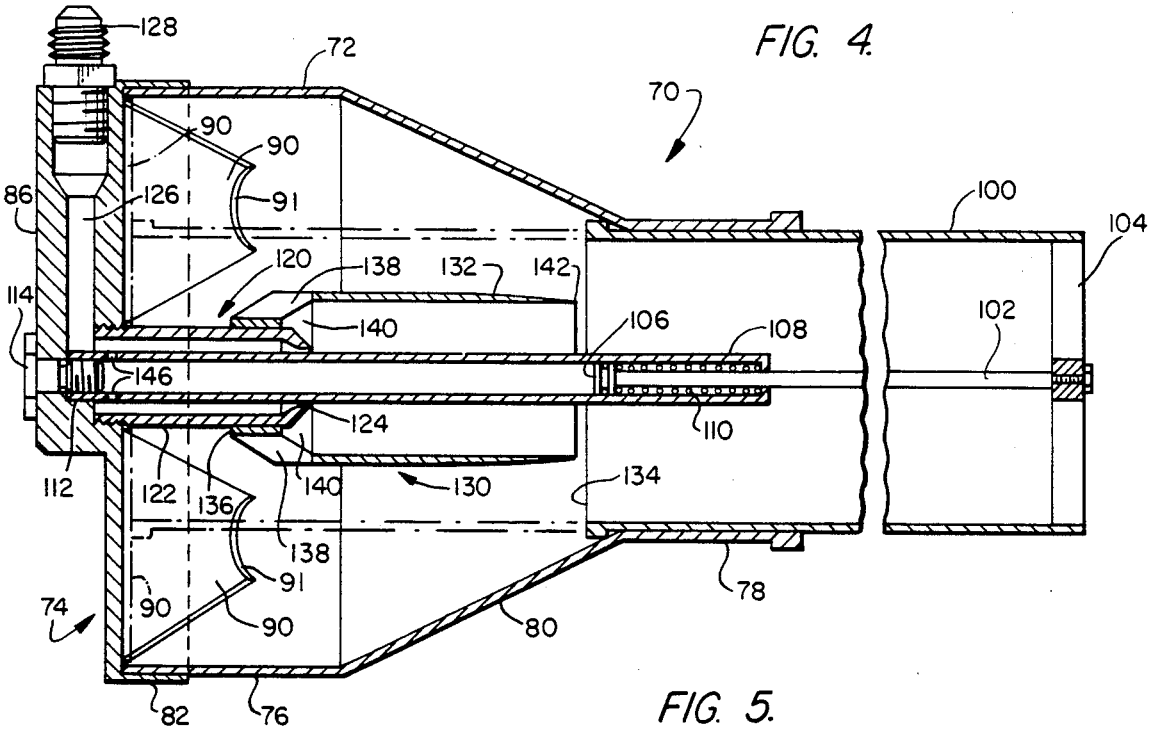
FIG. 4 is a longitudinal cross-sectional view of a first embodiment of an ejector in accordance with the invention.
Figure 6:
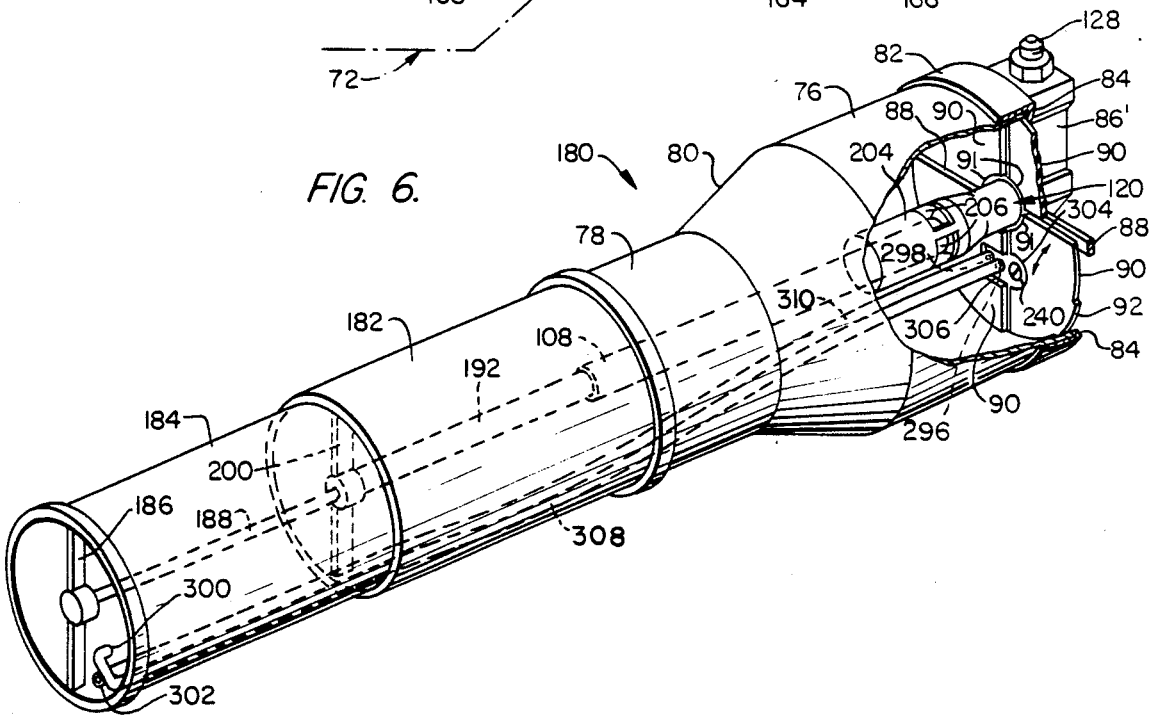
FIG. 6 is a perspective view, partially broken away, illustrating a second embodiment of an ejector in accordance with the invention.
Figure 7:
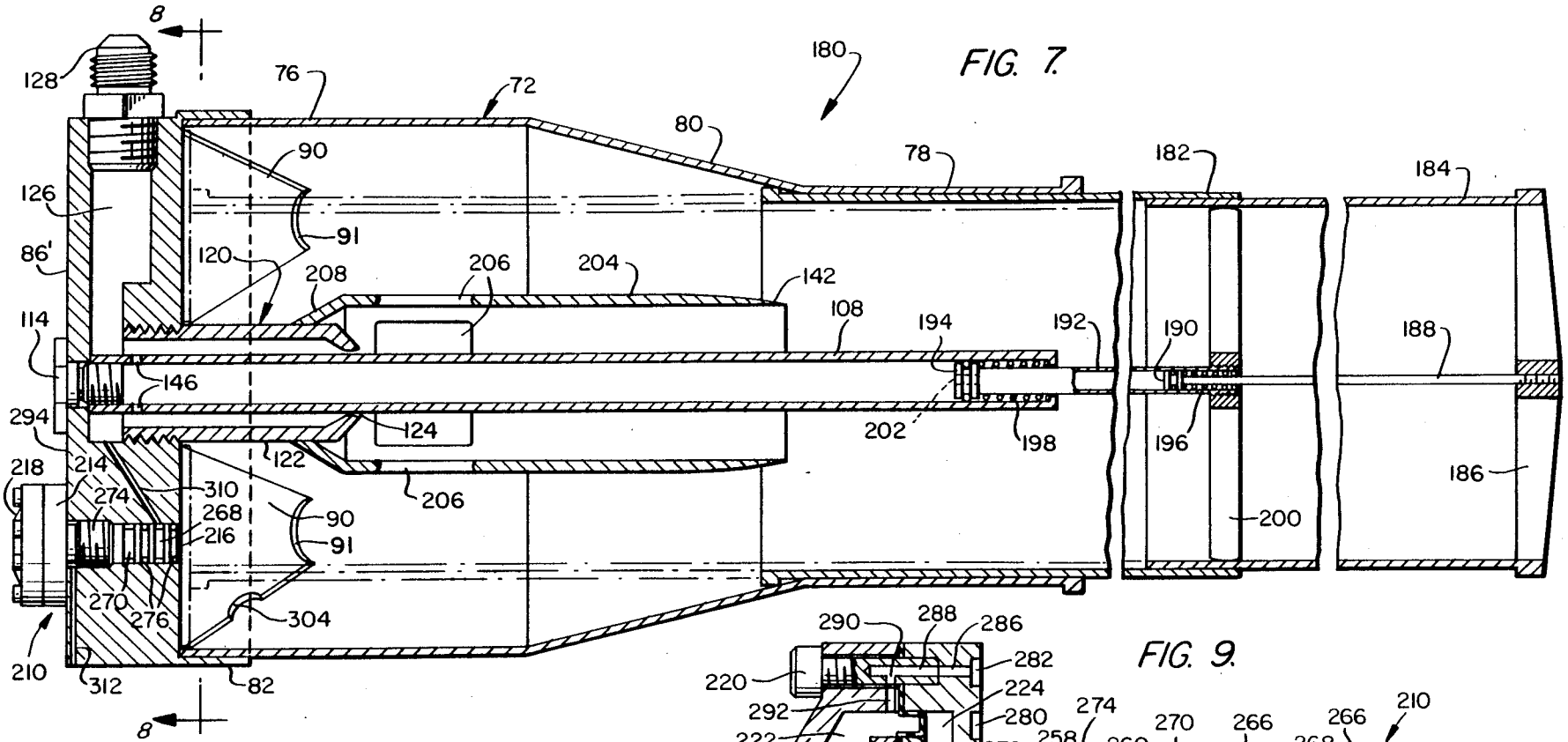
FIG. 7 is a longitudinal cross-sectional view of the ejector of FIG. 6.
Figure 8:
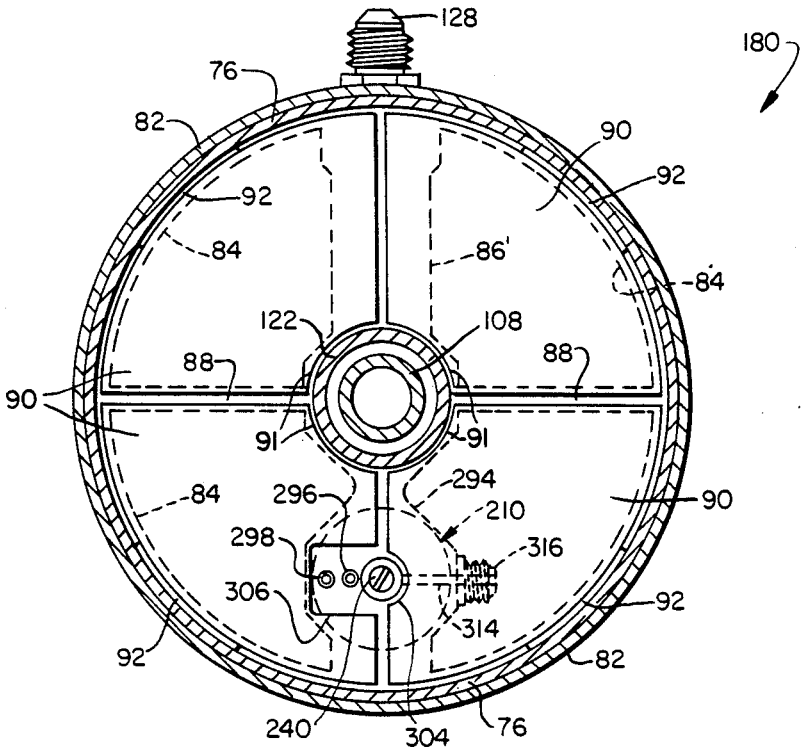
FIG. 8 is a transverse sectional view taken approximately along the lines 8—8 of FIG. 7.

FIG. 4 illustrates an ejector in accordance with a first embodiment of the invention. (FIGS. 6, 7 and 8 illustrate a second embodiment of an ejector in accordance with the invention which in certain respects is similar to the ejector of FIG. 4. Accordingly, in the description of the ejector of FIG. 4 that follows, references will be made to certain portions of FIGS. 6, 7 and 8 that illustrate in more detail parts of the two embodiments that may be similar.)

As shown in FIG. 4, an ejector 70 in accordance with a first embodiment of the invention comprises a housing that includes an inlet tube 72 and a base 74. The inlet tube may be formed from first and second spaced cylindrical sections 76, 78 of different diameters that are connected by a frustroconical section 80, as shown. Base 74 may comprise an annular member 82 sized to receive the end of cylindrical section 76 and having a radial lip 84 (see FIGS. 6 and 8) against which the end of cylindrical section 76 abuts. A base member 86 may extend diametrically across the circular opening formed by lip 84 (vertically in the figure), and preferably has a width (in the plane of the circular opening) substantially less than the diameter of the opening (see base member 86' in FIGS. 6 and 8). A pair of cross members 88 (see FIGS. 6 and 9) preferably positioned at right angles to member 86 (or 86') form another diametrically extending member positioned at right angles to base member 86 (or 86'). The openings formed between the base member and the cross members constitute inlets into the ejector for secondary gas, e.g., ambient air. The openings may be closed by four sector-shaped flapper-type valves 90 (best illustrated in FIGS. 6 and 8) that are preferably hinged at their circumference (as shown at 92 in FIG. 8) adjacent to lip 84. As will be explained shortly, when the ejector is operated, the flapper valves are adapted to swing open (as illustrated in FIGS. 4 and 7) to admit secondary gas into the ejector.

As is also shown in FIG. 4, a movable cylindrical draft tube 100 may be slideably supported within the inlet tube 72 by cylindrical section 78. The draft tube may be connected to a piston rod 102 by means of a spider member 104 at the outlet end of the draft tube. The piston rod may be connected to a piston 106 disposed within a cylinder 108 that is coaxial with the axis of the inlet tube. As shown in FIG. 4, cylinder 108 may be positioned within a hole 112 in base member 86, and may be attached to the base member by means of a bolt 114 threaded into the end of the cylinder. A spring 110 within cylinder 108 engages one side of piston 106 and an end portion of cylinder 108 to bias the piston and the draft tube to a non-extended or closed position (to the left in the figure), at which the draft tube assumes the position indicated by phantom lines. In the closed position, the draft tube engages flapper valves 90 and holds them in engagement with base member 86 (or 86') and cross members 88, thereby assisting the flapper valves in holding the secondary gas inlets to the ejector closed (for reasons which will be described hereinafter).

As is also shown in FIG. 4, a primary nozzle 120, which may comprise a tubular portion 122 threaded into base member 86 and having a converging outlet 124 spaced inwardly from base member 86, may be disposed coaxially about cylinder 108 (and about the axis of the ejector). The nozzle is in communication with a primary gas passageway 126 in the base member and a primary gas inlet fitting 128 that is threaded into the passageway in the end of the base member. A primary draft tube 130, which may comprise a cylindrical member 132 disposed coaxially about cylinder 108 and nozzle 120, extends from adjacent to the outlet 124 of the nozzle toward the inlet end 134 of draft tube 100 (when draft tube 100 is in an extended position, as illustrated). Primary draft tube 130 may be supported on the tubular portion 122 of the primary nozzle, as by a ring 136 threaded onto the tubular portion 122 that is connected to the cylindrical member 132 by ribs 138. As will be described in detail hereinafter, the inner diameter of draft tube 130 is somewhat greater than the diameter of the outlet 124 of the primary nozzle, and the spaces between ribs 138 provide inlet openings 140 in the primary draft tube (adjacent to nozzle outlet 124) for secondary gas. For reasons which will also be explained hereinafter, cylindrical member 132 may be tapered, as shown at 142, toward its outlet end.

Ejector 70 is a two-stage device. Primary nozzle 120 and primary draft tube 130 constitute the first stage of the ejector. The primary draft tube 130 and the movable draft tube 100 constitute the second stage of the ejector, the primary draft tube serving as the second stage nozzle. When primary gas enters the ejector through fitting 128, it flows through passageway 126 in base member 86, into the tubular portion 122 of the primary nozzle, and exits the primary nozzle at outlet 124. One or more small holes 146 may be provided through the wall of cylinder 108, as shown in FIG. 4, so that the pressure of the primary gas flowing through the nozzle can be applied to piston 106. The primary gas pressure on the piston acts against the bias of spring 110 to move the piston to the position illustrated in FIG. 4 and the draft tube 100 to its extended position. This allows flapper valves 90 to open in response to secondary gas entering the ejector. As will be explained shortly, primary gas exiting the primary nozzle outlet 124 flows through the primary draft tube 130, causing entrainment of secondary gas entering inlets 140 of the primary draft tube. The combined gas flow from the primary draft tube is then directed into the inlet 134 of draft tube 100, where it serves as the "primary" or inducing fluid for the second stage of the ejector and causes entrainment of large quantities of secondary gas.

Preferably, the diameter of cylindrical section 76 of inlet tube 72 is substantially greater than the diameter of draft tube 100, as shown, to enable a large unrestricted secondary gas flow into the ejector inlet tube. Hinging the flapper valves on the circumference of their circular portion adjacent to annular member 82, as previously described, also facilitates a large secondary flow into the ejector. When the flapper valves open in response to the vacuum created by the flow potentials in the draft tubes and the entering secondary gas, they swing away from the primary nozzle and, in open position, are adjacent to the inner surface of cylindrical section 76 so that they do not obstruct the secondary gas flow into inlets 140 of the primary draft tube or into inlet 134 of the second stage draft tube 100. The length of tubular portion 122 of primary nozzle 120 is selected to be at least long enough so that the inlet end of the primary draft tube 130 does not obstruct the opening and closing of the flapper valves. As shown in FIGS. 4 and 6–8, the end of each flapper valve adjacent to tubular portion 122 may have a circularly-shaped cut out 91 for clearance.

When primary pressure drops below a predetermined value, such as when the primary gas is almost exhausted, back pressure and the resilience of the flapper valves 90 causes the flapper valves to close and spring 110 returns draft tube 100 to its non-extended position, i.e., the phantom line position in FIG. 4, at which the draft tube engages the flapper valves to hold them closed. Unlike some prior art aspirators for inflating inflatable structures which employ flapper valves as a closure and which rely only upon the back pressure in the inflatable structure to hold the flapper valves closed, draft tube 100 serves as a positive closure to ensure that the flapper valves remain closed in the presence of external forces acting against the flapper valves to prevent deflation of the inflatable structure.

Figure 5:
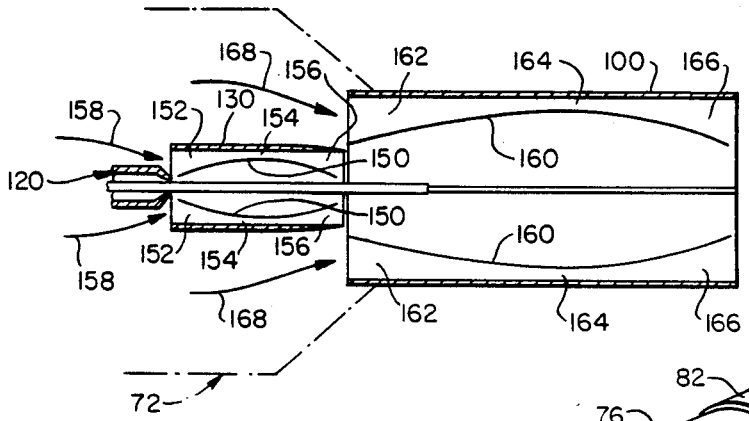
FIG. 5 is a diagrammatic view illustrating the operation of the ejector of FIG. 4.

Most known forms of mass flow augmentation devices operate either on venturi principles, wherein the flow of a high velocity primary aspirating fluid through a structure shaped to provide flow boundaries that form a venturi section creates a low pressure condition that produces entrainment of a secondary fluid, or on inelastic impact principles, wherein the collision between molecules of a plurality of jets of high velocity primary fluid flowing through a structure and the molecules of a secondary fluid causes the secondary fluid molecules to be accelerated and flow through the structure, producing entrainment of secondary fluid. In contrast, mass flow augmentation devices in accordance with the invention do not rely upon the flow of a primary fluid through a venturi formed by physical structure, or upon the inelastic collision between primary and secondary fluid molecules for the entrainment of secondary fluid. Rather, mass flow augmentation devices in accordance with the invention, such as the ejector of FIG. 4, operate in a substantially different manner. They employ flow-shaping of a fluid stream within a containment structure such that a flow potential is created that causes entrainment of a secondary fluid. The flow potential produces a venturi effect without physical surfaces that themselves define a venturi structure. FIG. 5 illustrates diagrammatically the ejector of FIG. 4 and the manner in which it operates.

High pressure primary gas supplied to the ejector flows through the primary nozzle 120. As the primary stream exits the nozzle it expands, as shown by the streamlines 150, to produce a primary stream (flowing from left-to-right in the figure) that is directed into the inlet of the primary draft tube 130. The primary stream leaving the nozzle is shaped (in accordance with well-known fluid dynamic principles) in such a way as to produce a Prandtl-Meyer expansion of the stream. The primary draft tube, which serves as a first-stage containment structure, is sized with respect to the primary stream 150 such that its inner surface provides a confining wall that cooperates with the Prandtl-Meyer expansion of the primary stream to create a converging section 152, a throat or choke section 154, and a diverging section 156. As the primary stream exits the primary nozzle outlet and expands, its velocity increases and its pressure decreases, producing a low-pressure region in the converging section 152 that causes secondary gas 158 to be drawn into the converging region. An energy exchange occurs between the fast-moving primary stream and the slow-moving stream of secondary gas flowing into the converging section so that the secondary stream is accelerated to a velocity approaching the local acoustic velocity. This produces a secondary stream flow through the draft tube in the same direction as the primary stream flow. As the secondary stream reaches throat section 154, its velocity becomes equal to the local acoustic velocity, and as it flows into diverging section 156, its velocity increases above the local acoustic velocity.

There is a continual energy exchange, i.e., mixing, between the primary stream and the secondary stream as the two streams flow through the primary draft tube. The velocities of the two streams exiting the primary draft tube are a function of the energy exchanged, which in turn is a function of the mixing length of the primary draft tube. As explained hereinafter, the primary draft tube length preferably is selected to provide a complete energy exchange such that the primary and secondary streams exit the primary draft tube with a common uniform velocity.

The mixed stream emanating from the outlet of the primary draft tube is then directed into the inlet end of the second stage draft tube 100, where it undergoes an expansion 160 similar to the expansion of the primary gas in the primary draft tube and where it serves as the inducing stream for the second stage of the ejector. Draft tube 100 serves as a second stage confinement structure that cooperates with expanding stream 160 in a manner similar to that described above to produce a converging section 162, a throat section 164 and a diverging section 166. The second stage of the ejector operates in the same manner as the first stage. The expanding stream 160 from the primary draft tube creates a flow potential that causes secondary gas 168 to be drawn into the inlet of the second stage draft tube 100 (as shown) and to be entrained to produce a combined flow through the second stage draft tube. The tapered end 142 of the primary draft tube (see FIG. 4) affords a smooth transition that reduces turbulence in the secondary gas 168 flowing past the end of the primary draft tube into the inlet of the second stage draft tube. The length of the second stage draft tube is also preferably selected so as to afford substantially complete mixing of the second stage inducing stream 160 and secondary induced stream 168 so that the combined streams exit the draft tube with a uniform velocity. Under such conditions, the highest mass fraction, i.e., efficiency, is obtained.

The diameter of each of the draft tubes is selected to give a desired throat-to-nozzle area ratio and for a desired flow rate through the draft tube. As noted earlier, the amount of energy transfer between the primary or inducing stream and the secondary or induced stream in each draft tube is a function of the mixing length of the draft tube. It is preferred that the length to diameter (L/D) ratio of each draft tube be greater than 2:1. For substantially complete mixing of the streams, the L/D ratio of each draft tube is preferably of the order of 6 to 8:1. As will be described shortly, FIGS. 6, 7 and 8 illustrate an ejector 180 in accordance with a second embodiment of the invention which enables such mixing lengths to be conveniently achieved with a rather compact structure and which affords other significant advantages.

The expansion characteristic of the primary stream within the primary draft tube 130 (and of the stream from the primary draft tube within the second stage draft tube 100) is a function of several different factors, including the primary gas pressure and the back pressure on the ejector. For a given primary pressure, the expansion tends to be reduced, i.e., restricted, as the back pressure increases, and to be increased as the back pressure is reduced. For the highest efficiency, it is desirable to maintain the expansion characteristic constant so as to produce a constant mass flow rate in the presence of back pressure variations. This can be accomplished conveniently by employing a system such as shown in FIG. 1 to control the primary pressure to the ejector to compensate for back pressure variations. By increasing the primary pressure as the back pressure increases and decreasing the primary pressure as the back pressure decreases, a constant expansion characteristic can be maintained easily in ejectors in accordance with the invention. Moreover, for applications where it is desirable to be able to control the total flow rate, this can be accomplished easily using ejectors in accordance with the invention by controlling the primary pressure to the ejector.

As shown in FIGS. 6 and 7, ejector 180 in accordance with a second embodiment of the invention employs a second stage draft tube comprising telescoping cylindrical draft tubes 182 and 184. As shown, draft tube 184 is sized to be slideably received within draft tube 182, which in turn is slideably received within cylindrical section 78 of the ejector housing. As best illustrated in FIG. 7, draft tube 184 may be connected via an appropriate spider member 186 and piston rod 188 to a piston 190 slideably disposed within a tubular member 192, which in turn is connected to a piston 194 slideably disposed within cylinder 108 to form a telescoping piston rod assembly. A spring 196 disposed between piston 190 and the end of tubular member 192 biases piston 190 to the left in the figure, thereby urging piston rod 188 to assume a non-extended position with respect to tubular member 192 and urging draft tube 184 to assume a non-extended position with respect to draft tube 182. Another spring 198 disposed between piston 194 and the end of cylinder 108 also biases piston 194 to the left in the figure and urges tubular member 192 to assume a non-extended position with respect to cylinder 108. A spider member 200, connected to the end of tubular member 192 and sized to slide within draft tube 184 supports the end of the tubular member within draft tube 184.

When primary gas is not being supplied to the ejector, springs 196 and 198 cause draft tubes 182 and 184 to assume non-extended positions within the ejector housing, as shown in phantom lines in FIG. 7, thereby providing a compact structure. When primary gas is supplied to the ejector, the primary gas pressure is applied to piston 194 via holes 146 in cylinder 108 and to piston 190 via a hole 202 through piston 194, causing the pistons to assume the positions illustrated in FIG. 7 and to extend the two draft tubes 182 and 184 to provide a substantial mixing length for the gases flowing therethrough. As in the ejector of the first embodiment, when draft tubes 182 and 184 are in a non-extended position, they may engage flapper valves 90 to ensure positive closure of the secondary gas inlets to the ejector housing.

As shown in FIG. 7, ejector 180 has a primary draft tube 204 formed slightly differently from draft tube 130 of ejector 70 in that the draft tube comprises a cylindrical member having apertures 206 in its side walls adjacent to the outlet 124 of the primary nozzle for admitting secondary gas, and is connected to the tubular portion of the primary nozzle by a conically-shaped end portion 208.

Significantly, ejector 180 may be formed with an integral controller 210 threaded into base member 86' for performing the functions of controller 20 of the system of FIG. 1, and may also include as part thereof dynamic and static pressure sensors for monitoring the dynamic flow pressure within the ejector and the static back pressure working against the ejector.

Figure 9:
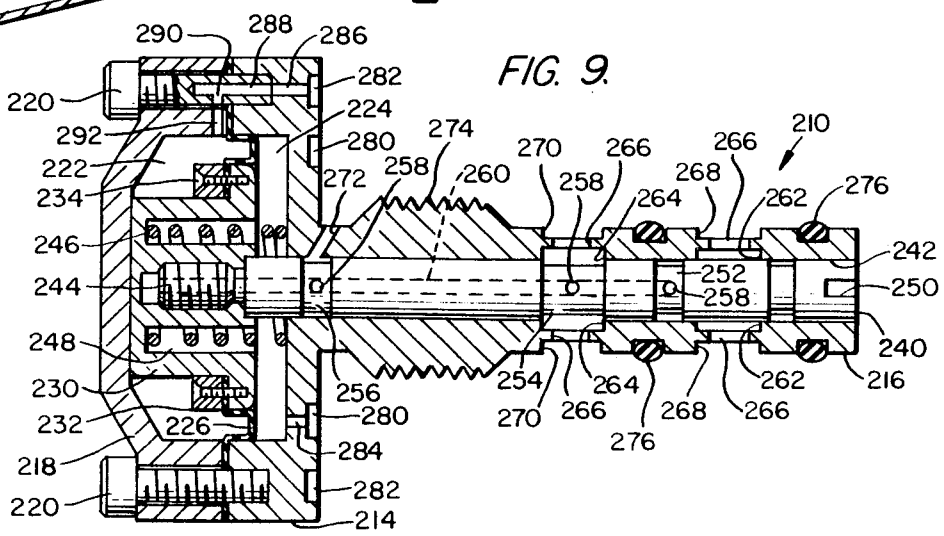
FIG. 9 is a longitudinal cross-sectional view of a controller which may be employed with the ejector of FIGS. 6–8.
Figure 10:
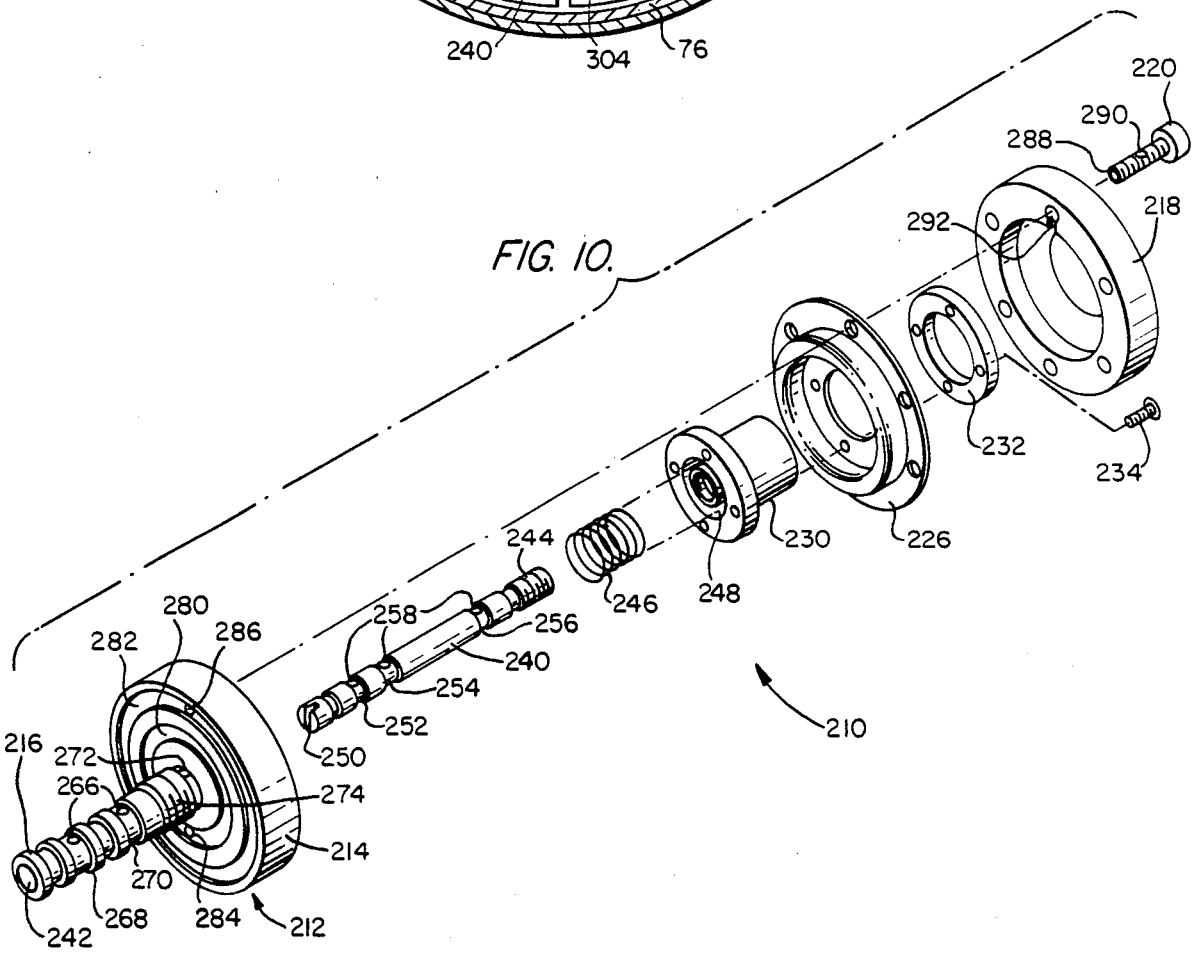
FIG. 10 is an exploded perspective view of the controller of FIG. 9.

Controller 210 is best illustrated in detail in FIGS. 9 and 10. As shown, the controller may comprise a generally T-shaped spool 212 formed by a circular, cup-shaped member 214 having an elongated, generally tubular member 216 extending coaxially therefrom. A domed cylindrical end cap 218 may be secured to cup-shaped member 214, as by bolts 220, to form an enclosure that is divided into first and second chambers 222 and 224 by a generally annular flexible diaphragm 226 positioned between cup-shaped member 214 and end cap 218, as shown in FIG. 9. A flanged cylindrical piston 230 may be connected to diaphragm 226 by a retainer ring 232 and screws 234, in the manner shown in FIG. 9. A spindle 240 slideably disposed within the bore 242 of tubular member 216, and sized for a close fit within the bore, may have threads 244 on one end thereof to enable the spindle to be threaded into the piston 230. A coil spring 246 may be located about the spindle in a concentric annular slot 248 in the piston. The spring engages the piston and the inner surface of cup-shaped member 214 (see FIG. 9) for biasing the piston and the spindle (to the left in the figure) to a predetermined position. The other end 250 of the spindle may be slotted for receiving a screwdriver, for example, to enable adjustment of the position of the spindle within bore 242.

Spindle 240 serves a function similar to poppet valves 52 and 54 of FIG. 1. As shown, the spindle may be formed with three circumferentially extending grooves 252, 254 and 256, each having a radially extending hole 258 therein intersecting an axial bore 260 that extends a portion of the length of the spindle. Holes 258 and bore 260 afford a fluid passageway between grooves 252, 254 and 256, respectively, so that the grooves are in communication with each other.

As shown in FIG. 9, bore 242 of tubular member 216 may be formed with circumferential grooves 262 and 264 that are in communication via holes 266 with aligned circumferential grooves 268 and 270, respectively, formed in the external surface of the tubular member.

As will be explained shortly, holes 266 between grooves 262 and 268 serve as the primary pressure inlet to the controller, and holes 266 between grooves 264 and 270 serve as the primary pressure feedback outlet from the controller. A hole 272 through the wall of the tubular member between a threaded portion 274 and the cup-shaped member 214 serves as the outside vent. O-ring seals 276 may be positioned in other grooves in the external surface of the tubular member, as shown.

The spindle is sized for a close fit within the bore of the tubular member, as previously noted, so that at certain positions the spindle is capable of sealing the primary pressure inlet and the feedback and vent outlets of the controller. Moreover, grooves 252, 254 and 256 are located in the spindle with respect to grooves 262 and 264 and vent 272, and sized with respect to grooves 262 and 264 and vent 272, such that the primary pressure feedback outlet of the controller (via groove 264) can be connected alternately to the primary pressure inlet of the controller (via groove 262) or to vent 272 by varying the position of the spindle within the bore. With the spindle located in its left-most position (the position illustrated in FIG. 9), a fluid passageway is provided between the primary pressure feedback outlet and vent hole 272 via holes 258 in spindle grooves 254 and 256 and spindle bore 260. In this position, the right end of the spindle spans groove 262, as shown, so that the primary pressure inlet to the controller is sealed and the primary pressure feedback outlet of the controller is vented to vent hole 272. When the spindle moves to its right-most position, as determined by the size of piston 230 and/or spring 246, the left end portion of the spindle between spindle groove 256 and threaded end 244 covers vent hole 272 to seal the outside vent, and spindle groove 252 overlaps a portion of bore groove 262 so that the primary pressure inlet to the controller is opened. The widths of spindle groove 254 and bore groove 264 are selected such that portions of these grooves are in overlapping relationship in both positions of the spindle. Thus, when the spindle is in its right-most position, the primary pressure feedback outlet from the controller is connected to the primary pressure inlet via holes 258 in spindle grooves 252 and 254 and spindle bore 260. Accordingly, the spindle operates in the same manner as poppet valves 52 and 54 of controller 20 of FIG. 1 to alternately connect the primary pressure feedback outlet to the primary pressure inlet or to the outside vent.

The movement of the spindle within the bore is controlled by the movement of diaphragm 226 in response to the pressure differential on opposite sides of the diaphragm. By applying the static pressure working against ejector 180 to chamber 222 and the dynamic pressure to chamber 224, the spindle position can be controlled in much the same manner that poppet valves 52 and 54 of controller 20 are controlled by diaphragm 50.

The static and dynamic pressures can be applied conveniently to opposite sides of the diaphragm as follows. As shown in FIGS. 9 and 10, the external surface of cup-shaped member 214 (from which tubular member 216 extends) may be formed with first and second concentric annular grooves 280 and 282. A small hole 284 may be positioned in the inner annular groove 280 and may extend through the wall of the cup-shaped member to provide a path between the inner annular groove 280 and chamber 224. Another small hole 286 may be positioned in the outer annular groove 282 such that it extends into a threaded hole in the side wall of the cup-shaped member that receives one of the bolts 220 (see FIG. 9) that attaches end cap 218 to the cup-shaped member. The bolt may have a coaxial bore 288 extending a portion of the length of the bolt such that when the bolt is threaded into the cup-shaped member side wall, bore 288 mates with hole 286 to provide a fluid path from annular groove 282 into the bolt. Another radial hole 290 through the side of the bolt and an aligned hole or notch 292 in end cap 218 provides a continuation of the fluid passageway into chamber 222 such that the chamber is in communication with annular groove 282.

As shown in FIG. 8, the lower portion 294 of base member 86' of the ejector may be enlarged such that when the controller 210 is threaded tightly into the ejector base member, the circular surface of the cup-shaped member containing annular grooves 280 and 282 is flush with the surface of the enlarged portion 294 of the base member so that a seal is provided between the annular grooves. A pair of small holes 296 and 298 (see FIG. 8) may extend completely through the enlarged portion 294 of the base member (parallel to the longitudinal axis of the ejector) and may be positioned at radial distances from the axis of the controller such that they are in communication with annular grooves 280 and 282, respectively. As shown in FIG. 6, holes 296 and 298 may be connected (as by lengths of small diameter flexible tubing 308, 310) to a dynamic pressure sensor 300 and a static pressure sensor 302, respectively, which may be positioned adjacent to the outlet of draft tube 184. The dynamic pressure sensor 300 may be a pitot tube and the static pressure sensor 302 may simply be the open end of the length of flexible tubing connected to hole 298. The dynamic and static pressure sensors monitor the dynamic pressure of the combined gas flow through the ejector and the static back pressure against which the ejector is working, respectively, and via the lengths of flexible tubing, holes 296 and 298, annular grooves 280 and 282 and holes 284, 286, 288 and 292 apply the dynamic and static pressures to chambers 224 and 222, respectively. The pressure differential between the static pressure in chamber 222 and the dynamic pressure in chamber 224 controls the position of diaphragm 226, which in turn controls the position of the spindle. As shown in FIGS. 6 and 8, the two lower (in the figures) flapper valves may have cut-outs 304 and 306 for the flexible tubes and for access to the end 250 of the spindle to enable adjustment of its position.

Fluid inlets and oulets to the controller may be provided in the base member of the ejector as follows. As shown in FIG. 7, the base member may be formed with a small diameter passageway 310 therein that connects the ejector primary gas inlet passageway 126 with circumferential groove 268 (primary pressure inlet) of the controller for supplying primary pressure to the controller. Another small diameter passageway 312 may be formed in the base member so as to be in communication with vent hole 272 of the controller to provide an outside vent. As shown in FIG. 8, still another small diameter passageway 314 may be formed in the base member in communication with an outlet fitting 316 to connect the outlet fitting to circumferential groove 270 of the controller. Passageway 314 and fitting 316 form the primary pressure feedback outlet from the controller.

From the foregoing, it may be appreciated that the ejector 180 and controller 210 afford a compact and convenient arrangement for implementing the system of FIG. 1, since it is only necessary to connect primary pressure inlet fitting 128 and feedback outlet fitting 316 to the primary gas outlet and to the feedback inlet, respectively, of a regulator associated with a primary gas source.

As noted earlier, conventional inflation systems typically employ a mixture of nitrogen and carbon dioxide as a primary gas mixture. In accordance with another aspect of the invention, it has been found that the performance of a conventional inflation system employing a standard aspirator can be significantly improved, and a given airslide can be inflated with a smaller quantity of primary gas, thereby reducing the size of the storage bottle, by employing a gas mixture of argon and carbon dioxide. The ratio of argon to carbon dioxide in percent by weight of the gas mixture may vary between 90% Ar-10% $CO_2$ and 10% Ar-90% $CO_2$. Preferred gas mixtures are of the order of 60% Ar-40% $CO_2$ to 50% Ar-50% $CO_2$.

The increased performance obtained by using an argon-carbon dioxide mixture is believed due to the fact that the larger gas molecules of the argon-carbon dioxide gas mixture have greater energy than do the molecules of a nitrogen-carbon dioxide mixture. Therefore, because of their greater energy, the molecules of the argon-carbon dioxide gas mixture can impart greater energy to the secondary gas, and a given quantity of secondary gas can be entrained using a smaller quantity of primary gas. Thus, a given airslide can be inflated more rapidly using an argon-carbon dioxide primary gas mixture, and the primary gas storage bottle size can be reduced.

Argon has the advantages of being inert, readily available, and low in cost. Carbon dioxide is desirable in the gas mixture since initially it flows out of the storage bottle faster than does argon to provide a faster initial inflation of the airslide. Employing an argon-carbon dioxide primary gas mixture with ejectors in accordance with the invention will also significantly increase their performance. Since ejectors in accordance with the invention have substantially higher efficiencies than conventional devices, an argon-carbon dioxide mixture affords a proportionally greater increase in performance.

To illustrate the significant advantages that the various aspects of the invention provide, it has been found that employing a standard aspirator with a nitrogencarbon dioxide primary gas mixture, a 188 cubic foot airslide (an average size) requires a 910 cubic inch bottle of primary gas and approximately 5–7 seconds for inflation. This is in a conventional inflation system which does not employ a controller for controlling the primary gas pressure in response to back pressure. In contrast, using the same primary gas mixture in the conventional system, but using an ejector in accordance with the invention, it has been found that the same airslide can be inflated using only a 500 cubic inch bottle of primary gas and in approximately 2¾ seconds. Thus, an ejector in accordance with the invention enables the airslide to be inflated in less than one-half the time required by a conventional aspirator and with approximately 40% less primary gas than is required by a conventional aspirator. This demonstrates dramatically the significantly improved efficiency of ejectors in accordance with the invention. The curve of FIG. 3 also shows (in bold lines) the substantial increase in efficiency (mass fraction) of ejectors in accordance with the invention over the standard accepted efficiency of conventional aspirators.

Using an ejector and a feedback control system (such as illustrated in FIG. 1), in accordance with the invention, it has been found that the airslide can be inflated with a primary gas bottle size of approximately 425 cubic inches, the inflation time remaining approximately the same. Moreover, by using a primary gas mixture of argon and carbon dioxide, the primary gas bottle size can be further reduced to approximately 375 cubic inches.

From the foregoing, it can be appreciated that systems, apparatus, components, and methods in accordance with the invention can provide significantly improved results over the prior art. Specifically, when used in pneumatic systems for inflating inflatable structures such as airslides, the invention enables a given airslide to be inflated much more rapidly and with a smaller quantity of primary gas than is possible using conventional systems, apparatus, components and methods. Moreover, by enabling the primary gas bottle size to be reduced by 50–60%, the invention enables significant weight reductions to be achieved. This is important, for example, when it is appreciated that commercial airliners may have as many as 10 or 12 exit doors, each with its own airslide and its own airslide inflation system. The reductions in primary gas bottle size and weight afforded by the invention can, therefore, be quite significant.

Although the various aspects of the invention have been described in connection with pneumatic apparatus and systems for inflating inflatable structures, it will be appreciated that the principles of the invention are applicable to other types of fluid systems. For example, ejectors in accordance with the invention may be used as jet pumps, or as a source of wind in a wind tunnel. In the latter case they can provide an efficiency increase of approximately 11–13% over conventional turbine fan wind sources.

While preferred embodiments of the invention have been shown and described, it will be apparent to those skilled in the art that changes can be made in these embodiments without departing from the principles and spirit of the invention, the scope of which is defined in the appended claims.

I claim:

1. Apparatus for controlling the pressure of a primary gas supplied to a mass flow augmentation device of the type that employs the flow of the primary gas through a containment structure for entraining a secondary fluid to produce a combined fluid flow through the containment structure, comprising a housing having a portion adapted to be received within a base member of the mass flow augmentation device, pressure sensitive means disposed within the housing, means for applying a static pressure to the pressure sensitive means, and means responsive to the pressure sensitive means for supplying an output signal adapted for controlling the primary gas pressure dependent upon the static pressure, said housing comprising a cup-shaped member having an elongated tubular portion extending therefrom, the tubular portion being adapted to be received within an opening in the base member with an adjacent surface of the cup-shaped member in engagement with a surface of the base member, the static pressure applying means comprising a groove in said surface of the cup-shaped member adapted to be aligned with a hole in the surface of the base member that is in communication with a static pressure sensor, the cup-shaped member having another hole therein to provide a passageway between the groove and a chamber within the housing.

2. The apparatus of claim 1, wherein the pressure sensitive means comprises a diaphragm within the chamber and movable valve means disposed within a bore of said tubular portion and connected to the diaphragm, and wherein said tubular portion has a first opening therethrough in communication with said valve means for receiving a portion of the primary gas pressure supplied to said mass flow augmentation device, a second opening therethrough in communication with the valve means for providing the output signal, the output signal being primary gas pressure, and a third opening therethrough for providing a vent, the valve means being adapted to alternately provide a fluid passageway between the first opening and the second opening and between the second opening and the third opening.

3. The apparatus of claim 2, wherein the valve means comprises a close-fitting spindle within the bore of the tubular portion, the spindle having an axial bore extending partially therethrough, having first, second and third circumferential grooves in its periphery, and having a radial hole located in each groove in communication with the axial bore, said grooves being positioned in the spindle with respect to said openings in the tubular portion such that in a first position of the spindle a fluid passageway is provided between the first and second openings and the third opening is sealed, and such that in a second position of the spindle a fluid passageway is provided between the second and third openings and the first opening is sealed.

4. The apparatus of claim 2 further comprising means for applying the dynamic pressure of the combined fluid flow to said diaphragm such that said diaphragm moves in response to the difference between the static pressure and the dynamic pressure, said dynamic pressure applying means comprising another groove in said surface of the cup-shaped member adapted to be aligned with another hole in the surface of the base member that is in communication with a dynamic pressure sensor, the cup-shaped member having another hole therethrough positioned in said other groove to communicate the dynamic pressure to the diaphragm.

5. The apparatus of claim 4, wherein said first-mentioned groove and said other groove comprise concentric annular grooves in the surface of the cup-shaped member, and wherein the surface of the cup-shaped member and the surface of the base member are cooperative to provide a fluid seal between said grooves.

6. Apparatus of the mass flow augmentation type comprising a housing having an inlet for primary gas and having an opening therein for secondary fluid, draft tube means associated with the housing, and means for producing a primary gas flow through the draft tube means so as to cause entrainment of secondary fluid, the draft tube means comprising movable telescoping draft tube sections normally biased together to a non-extended position at which the draft tube sections are in overlapping relationship and located substantially within the housing, and means responsive to the introduction of primary gas into the housing for moving the draft tube sections to an extended position at which the draft tube sections form a draft tube having a length that optimizes the energy transfer between the primary gas and the entrained secondary fluid.

7. The apparatus of claim 6, wherein said draft tube sections are sized such that in the extended position they provide a draft tube having a length-to-diameter ratio greater than 2:1.

8. The apparatus of claim 7, wherein the draft tube sections are sized to provide a length-to-diameter ratio of the order of 6 to 8:1.

* * * * *